United States Patent [19]

Gongwer

[11] Patent Number: 4,688,994

[45] Date of Patent: Aug. 25, 1987

[54] WATERCRAFT PROPULSION DEVICE

[75] Inventor: Calvin A. Gongwer, Glendora, Calif.

[73] Assignee: Innerspace Corporation, Covina, Calif.

[21] Appl. No.: 919,614

[22] Filed: Oct. 14, 1986

Related U.S. Application Data

[63] Continuation of Ser. No. 830,993, Feb. 19, 1986, abandoned.

[51] Int. Cl.[4] ..... B63H 1/36

[52] U.S. Cl. ..... 416/82; 416/74; 416/83

[58] Field of Search ..... 416/74, 79–83

[56] References Cited

U.S. PATENT DOCUMENTS

| | | | |
|---|---|---|---|
| 272,949 | 2/1883 | Freeman | 416/82 |
| 748,453 | 12/1903 | Worcester | 416/81 |
| 842,278 | 1/1907 | Wade | 416/81 |
| 871,059 | 11/1907 | Douse | 416/81 |
| 2,365,415 | 12/1944 | Kruse | 416/74 |
| 3,086,492 | 4/1963 | Holley | 416/79 X |
| 3,165,086 | 1/1965 | Eastep | 416/81 |
| 3,834,343 | 9/1974 | Hopkins | 416/74 X |
| 3,874,320 | 4/1975 | Wood | 416/81 X |
| 4,178,128 | 12/1979 | Gongwer | 416/82 X |

FOREIGN PATENT DOCUMENTS

| | | | |
|---|---|---|---|
| 2743323 | 4/1979 | Fed. Rep. of Germany | 416/79 |
| 2800678 | 7/1979 | Fed. Rep. of Germany | 416/79 |
| 1280528 | 11/1961 | France | 416/81 |
| 2044705 | 10/1980 | United Kingdom | 416/79 |

*Primary Examiner*—Everette A. Powell, Jr.
*Attorney, Agent, or Firm*—Lyon & Lyon

[57] ABSTRACT

A watercraft propulsion device having a forward and a rearward foil in nested relationship for reciprocal oscillating movement in opposite directions having a foil angle greater than 0° and less than 60°.

12 Claims, 6 Drawing Figures

WATERCRAFT PROPULSION DEVICE

This is a continuation of copending application Ser. No. 830,993 filed on Feb. 19, 1986, now abandoned.

BACKGROUND OF THE INVENTION

1. Field of the Invention

This invention pertains to a propulsion device for watercraft. More specifically, this invention pertains to an arrangement of nested foils that provide an efficient means of propulsion for watercraft.

2. Description of the Prior Art

It is known to utilize foils or blades in order to produce propulsion devices. See, for example, my U.S. Pat. Nos. 3,204,699, 3,122,759, 3,204,262 and 4,178,128. These all describe devices for providing propulsion with the use of foils and are extremely successful. The first three patents describe devices that produce a wake or a wash whose momentum and energy are not fully utilized. The fourth patent describes a nested foil arrangement which more fully utilizes the transverse component of the wake energy to provide for more forward thrust. The principles taught in the fourth patent have been utilized to devise a propulsion device that not only utilizes the transverse component of the wake energy, but also, through its unique configuration provides efficient propulsion with a minimum of aeration.

SUMMARY OF THE INVENTION

The present invention pertains to a nested arrangement of foils for watercraft that minimizes the problems of aeration while still providing for a smooth on-center net propulsive force to move the craft steadily without oscillation. These benefits are achieved through the use of two foils, a rearward and a forward foil, in a nested arrangement for alternate lateral pivotal movement in opposite directions. The motive force, whether it be human or otherwise, is transmitted to the foils through a linkage means such that reciprocal transverse oscillating motion is imparted to the foils. The foils are attached to the linkage means at an angle of from 0° to 60° from the linkage means axis of oscillation. Such a foil angle ensures that the transverse velocity of the deep water foil ends are greater than the transverse velocity of the water surface foil ends and decreases the angle of attack of the foil at the water surface. This results in increased efficiency and reduces the amount of air drawn down the foils from the surface.

Accordingly, it is an object of this invention to provide a watercraft propulsion device that is efficient and reduces the tendency to cause aeration.

DETAILED DESCRIPTION OF THE DRAWINGS AND PREFERRED EMBODIMENTS

Figure 1:
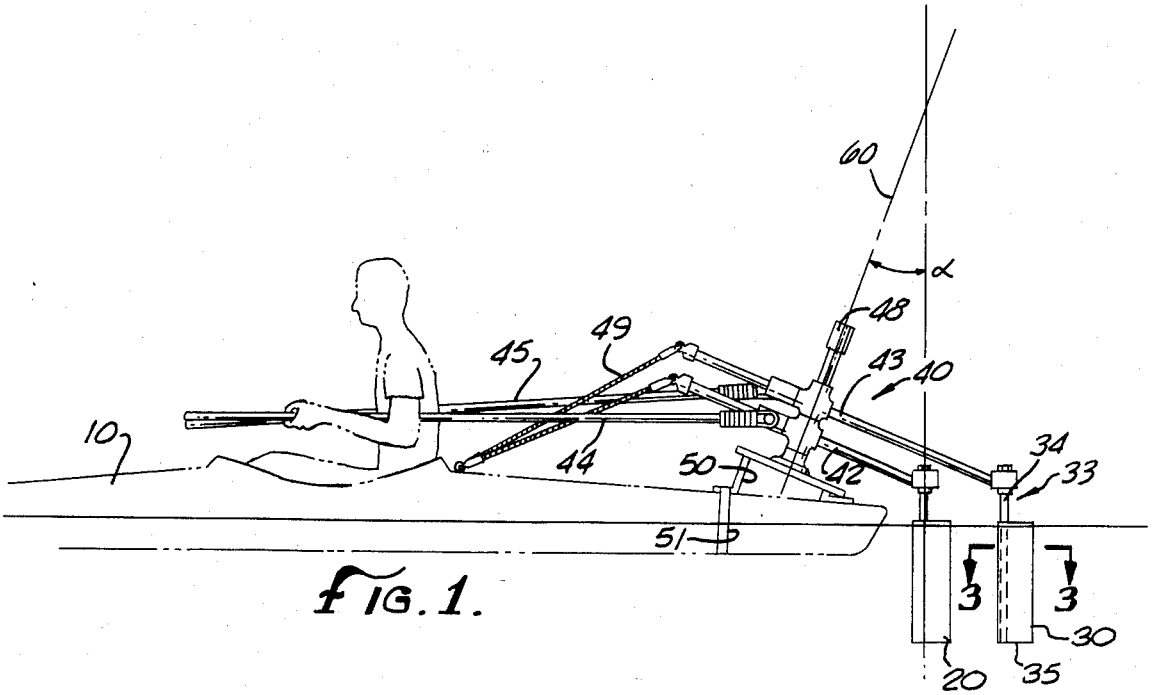
FIG. 1 is a front view of an embodiment of the invention.
Figure 2:
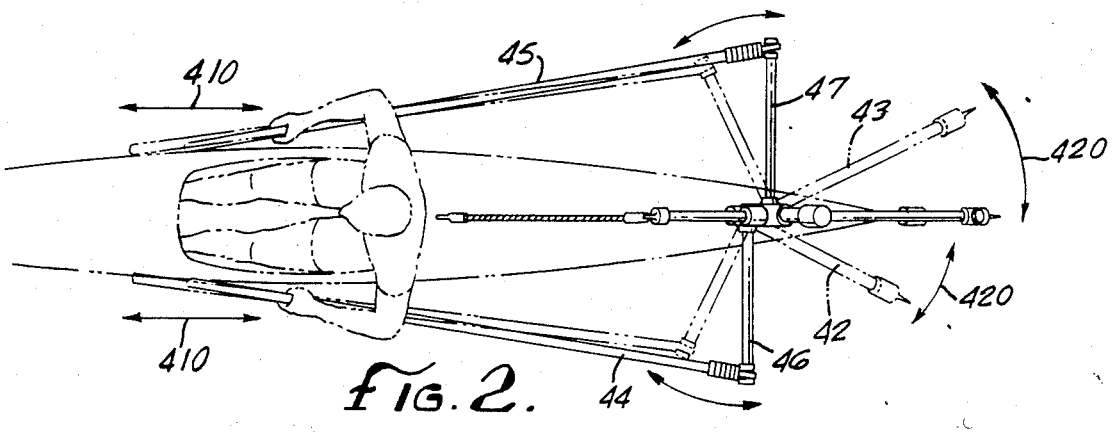
FIG. 2 is a top view of the embodiment shown in FIG. 1.

FIG. 1 is a front view of the present invention as utilized in a preferred embodiment. The watercraft shown is a kayak 10 being propelled by manual means. The forward foil 20 and the rearward foil 30 are arranged in a nested relationship. The foils are attached to linkage means, generally referred to as 40. In this embodiment the linkage means converts the fore-aft movement as shown by arrows 410 in FIG. 2 into reciprocal oscillating movement of the foils, as shown by arrows 420.

Figure 3:
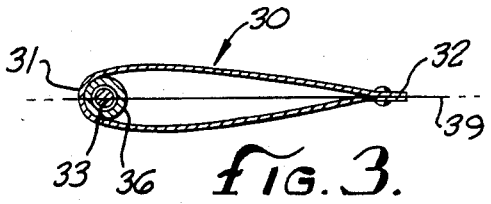
FIG. 3 is a cross sectional view of one of the foils taken along plane 3—3 of FIG. 1.

Forward foil 20 and rearward foil 30 are of the same construction and for simplicity only the rearward foil 30 will be described. As is best shown in FIGS. 1 and 3, the foils are comprised of a leading edge 31, a trailing edge 32, a hollow shaft 36 and a torsion rod 33. The foil in this embodiment is formed from thin sheet metal and securely fixed at the trailing edge. Other types of construction are possible so long as the aerodynamic shape of the foil is maintained. The hollow shaft 36 extends through the foil 30 with one end being securely attached to the linkage means. The foil 30 is free to rotate about the hollow shaft 36.

The torsion rod, which has a first end 34 and a second end 35, extends through the hollow shaft 36 parallel to the leading edge 31. The first ends 34 are attached to the linkage means 40 such that the forward and rearward foils, 20 and 30, are substantially parallel, and in this embodiment, substantially vertical. The second ends 35 are securely attached to the foil. Thus, the torsion rod 33 acts to restrict the pivoting of the foils. Experimentation has shown that the foil angle, designated alpha, which is the angle between the longitudinal axis of the torsion rod 33 and the linkage means axis of oscillation, line 60 in FIG. 1, should be between 0° and 60°, preferably greater than or equal to 30° and less than or equal to 45°, optimally 35°, to achieve the benefits of this invention.

As is explained more fully in my U.S. Pat. No. 4,178,128, which is incorporated herein by reference, the hollow shaft 36 passes through the foil 30 at the foil pivot point, which pivot point should be less than a quarter chord length from the leading edge 31 of the foil along the leading edge/trailing edge chord, line 39. This position allows the foils to automatically feather. Further, the torsion rod 33 in the rearward foil may be made to restrict the pivoting of the foils more than the torsion rod 33 in the forward foil to balance the forces.

The linkage means 40, in this embodiment, is comprised of a forward and rearward foil arm, 42 and 43, a forward and rearward foil actuator arm, 44 and 45, a forward and rearward foil connecting rod, 46 and 47, and a shaft 48. One end of each of the actuator arms 44 and 45, is attached to a drive means, in this embodiment a human arm, and the other end is freely attached to the respective connecting rods, 46 and 47. The free attachment of the actuator arms, 44 and 45, to the connecting rods, 46 and 47, may be satisfactorily accomplished through the use of a universal joint coupler. The connecting rods 46 and 47, are rigidly attached to the respective arms, 42 and 43. The forward and rearward foil arms, 42 and 43, are each separately rotatably attached to the shaft 48 such that the longitudinal axes of the arms, 42 and 43, and the longitudinal axis of the connecting rods, 46 and 47, are perpendicular to the longitudinal axis of the shaft 48.

The shaft 48 is attached to the kayak 10 by a mounting plate 50. The mounting plate 50 is attached to the kayak by a clamp 51. The clamp and mounting plate can be of any design so long as the linkage means 40 is securely affixed to the watercraft.

Biasing means 49 are employed to tune out a portion of the reciprocating inertia. These are advantageously attached to the ends of the forward and rearward arms, 42 and 43, and secured to a centrally located point on the watercraft.

Figure 6:
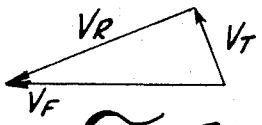
FIG. 6 is a velocity triangle.
Figure 4:
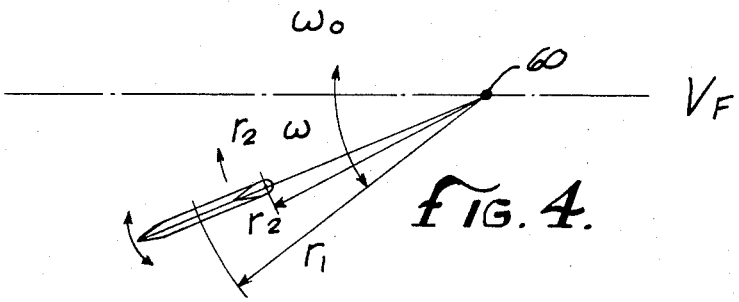
FIG. 4 is a view from along the axis of oscillation, along plane 4—4 of FIG. 5.
Figure 5:
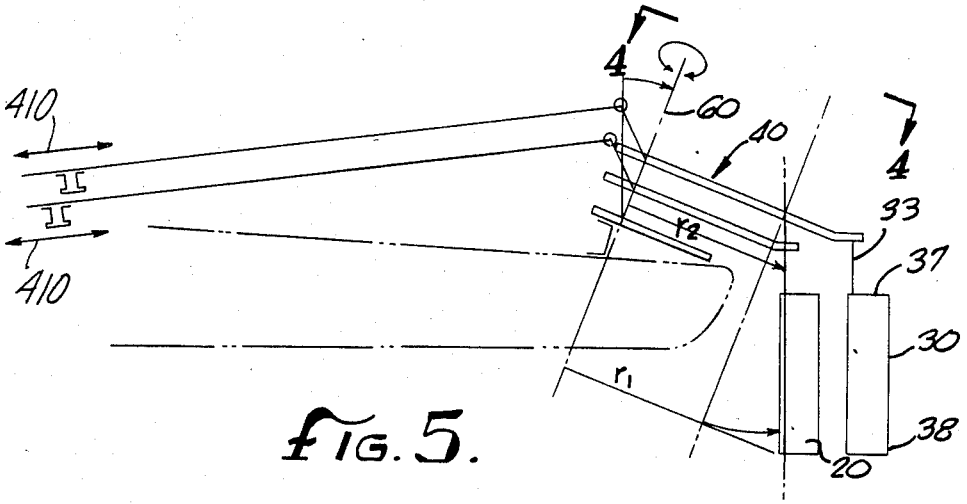
FIG. 5 is a diagram of the present invention.

The advantages of the invention can be seen by reference to the diagrams in FIGS. 4, 5 and 6. The linkage means oscillation axis, represented by line 60, corresponds to the shaft 48 in the preferred embodiment. The foil is positioned at an angle alpha to the linkage means 40 called the foil angle. The oscillation axis, although shown at the angle alpha from vertical, may be at some other angle so long as alpha is always greater than or equal to the angle from vertical of the oscillation axis. The water surface end of the foil 37 is a distance r2 from the oscillation axis 60, whereas the deep water end of the foil 38 is a distance r1 from the oscillation axis. This unloads the foil at the water surface end 37, reducing the tendency for aeration, while still achieving optimum overall forward velocity.

For the desired results of the invention to be achieved r1 must be greater than r2. With r1 greater than r2 the transverse velocity of the deep water end 38 will always be greater than the transverse velocity of the water surface end 37. This is apparent from the comparison of velocity triangles at each point. A typical velocity triangle is shown in FIG. 6, where $V_t$ is the transverse velocity, $V_r$ is the resultant velocity and $V_f$ is the forward velocity.

A plurality of rearward and forward foils may also be employed. In such an embodiment the motive force could be supplied by an electrical or mechanical drive means.

While embodiments and applications of this invention have been shown and described, it will be apparent to those skilled in the art that many more modifications are possible without departing from the inventive concepts described herein. The invention therefore is not to be restricted except in the spirit of the appended claims.

I claim:

1. A watercraft propulsion device comprising a forward foil and a rearward foil in a nested relationship for alternate lateral pivotal movement in opposite directions;

each of said foils comprise a leading edge, a trailing edge, a hollow shaft and a torsion rod having a first end and a second end; said hollow shaft is attached to said linkage means and extends through said foil at a point located less than a quarter chord length from said leading edge along the leading edge/-trailing edge chord; said foil being capable of pivoting about said hollow shaft; said torsion rod is attached to and extends through said hollow tube parallel to said leading edge;

said first end of each torsion rod is attached to linkage means such that said forward and rearward torsion rods are substantially parallel and form a foil angle alpha between the linkage means axis of oscillation and said torsion rods, wherein said foil angle is greater than 0° and less than 60°; and, said second end of each torsion rod is securely attached to said foil.

2. A watercraft propulsion device of claim 1 wherein said foil angle is greater than or equal to 30°;and less than or equal to 45°.

3. A watercraft propulsion device of claim 1 wherein said foil angle is equal to 35°.

4. A watercraft propulsion device comprising a forward foil and a rearward foil in a nested relationship for alternate lateral pivotal movement in opposite directions and linkage means;

each of said foils comprise a leading edge, a trailing edge, a hollow shaft and a torsion rod having a first end and a second end; said hollow shaft is attached to said linkage means and extends through said foil at a point located less than a quarter chord length from said leading edge along the leading edge/-trailing edge chord; said foil being capable of pivoting about said hollow shaft; said torsion rod is attached to and extends through said hollow tube parallel to said leading edge;

said linkage means comprises a forward and rearward foil arm, a forward and rearward foil actuator arm, a forward and rearward foil connecting rod and a shaft; one end of each of said actuator arms is attached to a drive means and the other end is freely attached to said respective connecting rod; said connecting rods are rigidly attached to said respective arms; said forward and rearward foil arms are each separately rotatably attached to said shaft such that the longitudinal axes of said arms and said connecting rods are perpendicular to the longitudinal axis of said shaft;

said first end of each torsion rod is attached to said respective arm such that said forward foil torsion rod and said rearward foil torsion rod are substantially parallel and form a foil angle between the axis of oscillation of said arms and said torsion rods; wherein said foil angle is greater than 0° and less than 60°; said second end of each torsion rod is securely attached to said foil.

5. A watercraft. propulsion device of claim 4 wherein said foil angle is greater than or equal to 30° and less than or equal to 45°.

6. A watercraft propulsion device of claim 4 wherein said foil angle is equal to 35°.

7. A kayak propulsion device comprising a forward foil and a rearward foil in a nested relationship for alternate lateral pivotal movement in opposite directions;

each of said foils comprise a leading edge, a trailing edge, a hollow shaft and a torsion rod having a first end and a second end; said hollow shaft is attached to said linkage means and extends through said foil at a point located less than a quarter chord length from said leading edge along the leading edge/-trailing edge chord; said foil being capable of pivoting about said hollow shaft; said torsion rod is attached to and extends through said hollow tube parallel to said leading edge;

said first end of each torsion rod is attached to linkage means such that said forward and rearward torsion rods are substantially parallel and substantially vertical and form a foil angle between the linkage means axis of oscillation and said torsion rods, wherein said foil angle is greater than 0° and less than 60°; and, said second end of each torsion rod is securely attached to said foil.

8. The kayak propulsion device as claimed in claim 7 wherein said linkage means comprises a forward and rearward foil arm, a forward and rearward foil actuator arm, a forward and rearward foil connecting rod and a shaft; one end of each of said actuator arms is attached to a drive means and the other end is freely attached to said respective connecting rod; said connecting rods are rigidly attached to said respective arms; said forward and rearward foil arms are each separately rotatably attached to said shaft such that the longitudinal axes of said arms and said connecting rods are perpendicular to the longitudinal axis of said shaft;

said first end of each torsion rod is attached to said respective arm such that said forward foil torsion rod and said rearward foil torsion rod are substantially parallel and form a foil angle between the axis of oscillation of said arms and said torsion rods; wherein said foil angle is greater than or equal to 30° and less than or equal to 45°.

9. The kayak propulsion device as claimed in claim 8 wherein said foil angle is equal to 35°.

10. The kayak propulsion device as claimed in claim 8 further comprising a biasing means between said forward and rearward arms and a point centrally located on the kayak.

11. A watercraft propulsion device comprising a plurality of forward foils and rearward foils in nested relationships for alternate lateral pivotal movement in opposite directions;

each of said foils comprise a leading edge, a trailing edge, a hollow shaft and a torsion rod having a first end and a second end; said hollow shaft is attached to said linkage means and extends through said foil at a point located less than a quarter chord length from said leading edge along the leading edge/-trailing edge chord; said foil being capable of pivoting about said hollow shaft; said torsion rod is attached to and extends through said hollow tube parallel to said leading edge;

said first end of each torsion rod is attached to linkage means such that said forward and rearward torsion rods are substantially parallel and form a foil angle between the linkage means axis of oscillation and said torsion rods, wherein said foil angle is greater than 0° and less than 60°; and, said second end of each torsion rod is securely attached to said foil.

12. A watercraft propulsion device comprising a forward foil and a rearward foil in a nested relationship for alternate lateral pivotal movement in opposite directions;

each of said foils comprise a leading edge, a trailing edge, a hollow shaft and a torsion rod having a first end and a second end; said hollow shaft is attached to said linkage means and extends through said foil at a point located less than a quarter chord length from said leading edge along the leading edge/-trailing edge chord; said foil being capable of pivoting about said hollow shaft; said torsion rod is attached to and extends through said hollow tube parallel to said leading edge;

said first end of each torsion rod is attached to linkage means such that said forward and rearward torsion rods are substantially parallel and form a foil angle alpha between the linkage means axis of oscillation and said torsion rods, wherein said foil angle is greater than or equal to 0° and less than or equal to 90°; and, said second end of each torsion rod is securely attached to said foil.

* * * * *